United States Patent [19]

Watashi

[11] Patent Number: 4,764,790

[45] Date of Patent: Aug. 16, 1988

[54] METHOD FOR CLEANING PHOTORECEPTOR OF IMAGE FORMING APPARATUS

[75] Inventor: Masahiro Watashi, Nara, Japan

[73] Assignee: Mita Industrial Co., Ltd., Osaka, Japan

[21] Appl. No.: 53,167

[22] Filed: May 21, 1987

[30] Foreign Application Priority Data

May 30, 1986 [JP] Japan ..... 61-126962

[51] Int. Cl.[4] ..... G03G 21/00

[52] U.S. Cl. ..... 355/15; 355/3 DD; 355/4; 355/77; 355/14 R; 355/14 D; 430/125

[58] Field of Search ..... 355/15, 3 DD, 4, 77, 355/14 R, 14 D; 430/125

[56] References Cited

U.S. PATENT DOCUMENTS 3,728,016 4/1973 Harbour et al. ..... 355/15
3,937,570 2/1976 Hudson ..... 355/3 DD
4,154,522 5/1979 Ikesue ..... 355/15
4,481,275 11/1984 Iseki et al. ..... 355/15 X
4,518,248 5/1985 Nishikawa ..... 355/15

FOREIGN PATENT DOCUMENTS 59-152477 8/1984 Japan .

*Primary Examiner*—R. L. Moses
*Attorney, Agent, or Firm*—Jordan and Hamburg

[57] ABSTRACT

A method for cleaning a photoreceptor of an image forming apparatus includes actuating a cleaning means of a cleaning system and rotating the photoreceptor before a usual image forming operation, after a predetermined time, charging a particular area of the photosensitive drum, transferring residual toner adhering to a sealing member of a developing unit to the charged area, carrying the transferred residual toner with rotation of the photoreceptor to the cleaning means of the cleaning device, and removing the residual toner by the cleaning means. Accordingly, the present invention eliminates the possibility of mixing of the color of a previously used toner into a toner image after replacement of a developing unit by another unit containing a different color of toner.

13 Claims, 2 Drawing Sheets

METHOD FOR CLEANING PHOTORECEPTOR OF IMAGE FORMING APPARATUS

BACKGROUND OF THE INVENTION AND RELATED ART STATEMENT

The present invention relates to a cleaning method for a photoreceptor provided in image forming apparatus such as an electrostatic copying machine.

On the periphery of a photosensitive drum provided in image forming apparatus, the main charger, developing unit, image transfer device, separating device, cleaning device, etc. are disposed in that order in the direction of rotation.

The above-mentioned cleaning device is equipped with a cleaning means such as a cleaning blade or fur brush. Taking for example, the cleaning blade adopted for a copying machine having an image forming apparatus, the blade is so designed that it is turned on at the start of the copying action, comes in contact with the surface of the photosensitive drum so as to remove the residual toner from the surface of the drum and is turned off at the end of the copying action (see unexamined Patent Publication No. 46580/1985 for example).

However, when replacing a developing unit by another unit containing toner of a different colour to change the colour of copying and starting the copying action, it sometimes happens that the colour of the residual toner of a previous developing unit is mixed in a copied image. The cause of this kind of mixing of the colour of residual toner in the copied image is as follows. When the cleaning blade is turned off at the end of the copying action before the replacement of the developing unit, part of the residual toner accumulated at the upstream of the edge of the cleaning blade passes to the downstream side of the edge of the cleaning blade. Next, when starting copying operation by actuating the cleaning blade after replacing the developing unit, the residual toner at the downstream of the edge of the above-mentioned blade adheres to the photosensitive drum. This toner is then carried by the rotation of the drum to attach to a sealing member for protection against splashing provided at the top of the case of the developing unit. After that, this attached toner is adsorbed by an electrostatic latent image formed on the photosensitive drum and, as a result, transferred to the copying paper.

In the case of a cleaning device using a fur brush, the brush is made to come in contact with a photosensitive drum as it turns and the toner scraped down by the brush is exhausted by a fan. The part surrounding the fur brush is sealed with a sealing member. It sometimes occurs that the toner attaches to the downstream side face of the sealing member and, as a result, is mixed in the image as in the case of the replacement of the developing units mentioned above.

By such action, deterioration of the quality of the copied image occurs sometimes with the conventional type of multicolour developing unit when it is replaced by another unit of different colour, and an improvement in this respect has been strongly demanded.

SUMMARY OF THE INVENTION

The invention has as its object to provide a method for cleaning photoreceptor of an image forming apparatus by overcoming the above-mentioned technical problems, namely preventing a mixing of the colour of the previous toner into the copied picture, after replacement of a developing unit by another unit containing a toner of different colour for change of colour, in order to avoid a deterioration of the quality of a toner image.

Namely, this invention makes it possible to always obtain a clear monochrome toner image even if the image forming action is made after changing a developing unit by another unit containing toner of a different colour, by adsorbing the residual toner attached to the sealing member for protection against splashing of the developing unit by a charged area of the photoreceptor, before it passes to the normal image forming action, and carrying it to the cleaning blade area of the cleaning device. This thus prevents deterioration of the quality of a toner image. The present invention also provides a cleaning method easily adaptable to conventional image forming apparatus such as a copying machine.

DETAILED DESCRIPTION OF PREFERRED EMBODIMENT OF THE INVENTION

Figure 1:
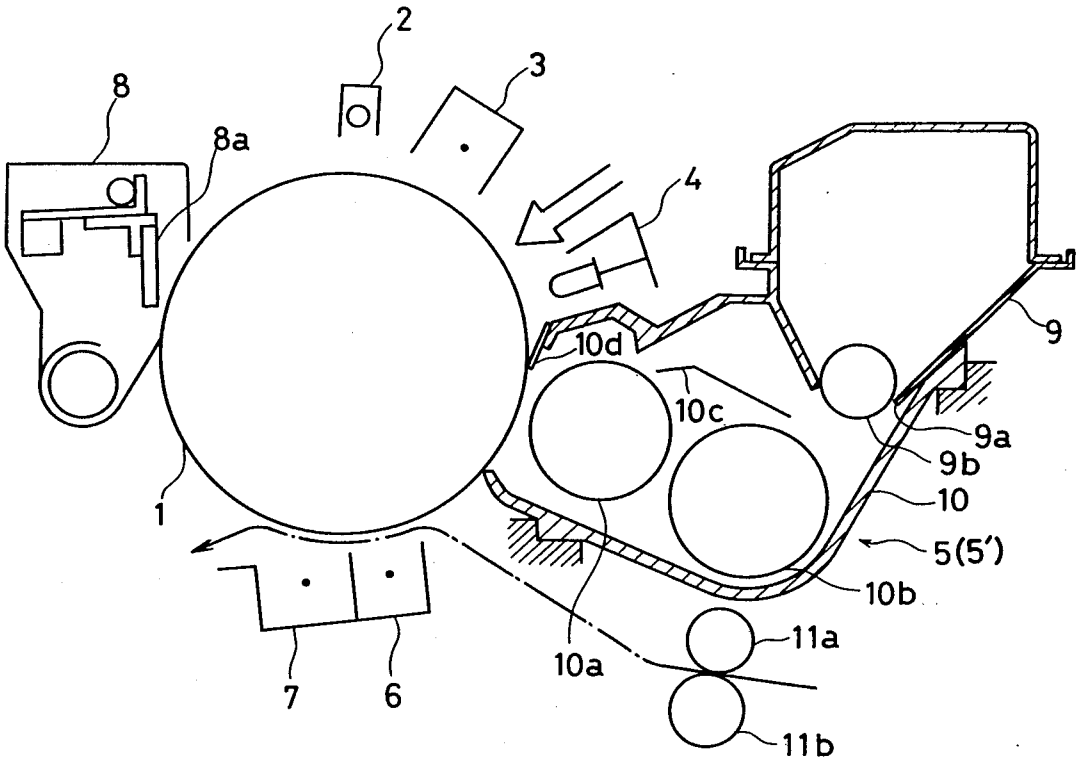
FIG. 1 is a schematic front view of a photosensitive drum and its surroundings of an electrostatic copying machine using a photoreceptor cleaning method of the present invention.

FIG. 1 is a schematic front view of a photosensitive drum and its surroundings on an electrostatic copying machine using a photoreceptor cleaning method in accordance with the present invention.

In FIG. 1, there are a discharge lamp 2 for removing a residual electric charge, a main charger 3 including a corona charging unit, etc., a blank lamp 4 for erasing electric charge on an unnecessary part of the photosensitive drum 1 depending on the size of copying paper, a developing unit 5, an image transfer device 6, a separating device 7, a cleaning device 8, etc. disposed around a photosensitive drum 1 in the direction of rotation. An exposure area is provided on the photosensitive drum between the main charger 3 and the blank lamp 4.

Figure 2:
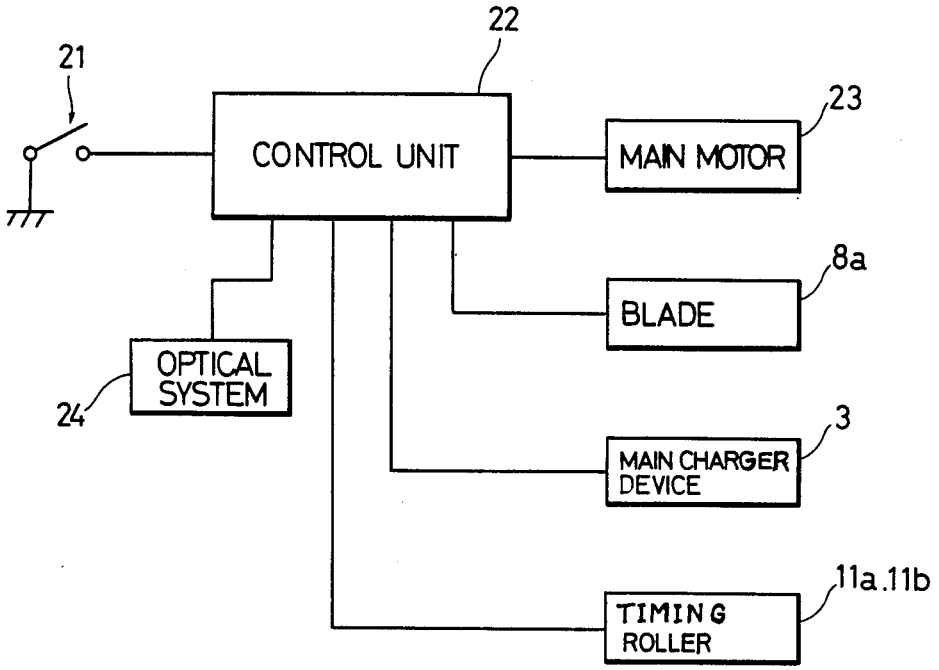
FIG. 2 is a block diagram showing the cleaning method of the photoreceptor.

The above-mentioned developing unit 5 includes a toner hopper 9 and a developing unit 10. The toner hopper 9 is provided at its lower end with a feed outlet **9*a* for supplying toner to the developing unit 10 and a feed roller 9*b* at the position opposite to the feed outlet 9*a* in the toner hopper 9. The developing unit 10 is provided with a developing roller 10*a* to supply the powder of the developing toner to the photosensitive drum 1 and develop the electrostatic latent image formed by the above exposure into a toner image, an agitating roller 10*b* for agitating the toner supplied from the toner hopper 9, a guide plate 10*c* for guiding the toner adhering to the developing roller 10*a* to the agitating roller 10*b*, and a sealing member 10*d* for preventing developer contained in the developing unit 10 from escaping from the unit. On the upstream side of the image transfer device 6, timing rollers 11*a* and 11*b* are provided for feeding copying paper to the image transfer device 6. The image transfer device serves to electrostatically transfer toner image formed on the photosensitive drum 1 to copying paper conveyed by the timing rollers 11*a*, 11*b*. The separating device 7 includes a corona charging unit, etc. and serves to detach copying paper from the photosensitive drum 1 after the image transfer. The cleaning device 8 has a blade 8***a* and scrapes off residual toner from the surface of the photosensitive drum 1 after image transfer and separation. Now referring to the block diagram of FIG. 2 and the timing chart of FIG. 3, the cleaning method will be described in the copying action after replacement of a developing unit 5 by another unit 5' containing toner of a different colour, which is adopted for removing residual toner adhering to the sealing member 10 as mentioned above.

To change the colour of a copy, the developing unit 5 is replaced by another unit containing toner of different colour. When the developing unit 5 is changed, a loading signal indicating that the developing unit has been changed (signals are provided for each developing unit to show what colour toner is in a developing unit loaded in the copying machine) is sent to a terminal of the copying machine. The terminal is connected to a processing circuit, etc. and is provided to receive a loading signal. After that, the print key 21 provided on the copying machine is operated. Accordingly, when operating the print key 21 after receiving a loading signal, the following actions are performed.

Figure 3:
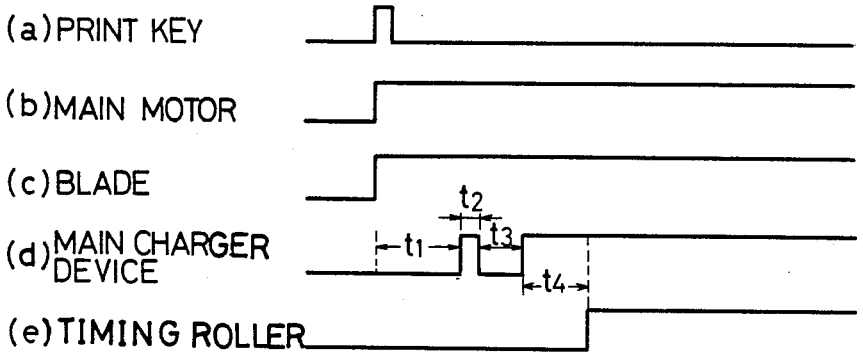
FIG. 3 is a time chart showing the cleaning method of the photoreceptor.

The control unit 22 receives a print key signal indicating that the print key 21 has been operated as shown in FIG. 3 (*a*), and drives the main motor 23 at the timing as shown in FIG. 3 (*b*) in response to the print key signal to turn the photosensitive drum 1, and at the same time actuates the cleaning blade 8*a* at the timing as shown in FIG. 3 (*c*). In the case that the photosensitive drum 1 is rotated while the cleaning blade 8*a* is held in contact with the drum this way, it sometimes happens that residual toner which has moved to the downstream side of the edge of the cleaning blade 8*a* and adhered to the photosensitive drum 1 in the OFF time of the cleaning blade 8*a* reaches the developing unit 5 and then adheres to the sealing member 10*d*. If copying operation is executed with such residual toner adhering to the sealing member 10*d*, the residual toner is attracted to an electrostatic latent image formed on the photosensitive drum 1 and the latent image is transferred. As a result, the colour of the residual toner is mixed in a copied image.

To prevent this, when the residual toner carried on the photosensitive drum 1 from the cleaning blade 8*a* passes through the main charger 3, a certain area of the photosensitive drum 1 is charged. For example, after a given time t1 after turn-on of the cleaning blade 8*a* as shown in FIG. 3 (*d*), the main charger unit 3 is put into operation for time t2 to charge a given area of the photosensitive drum 1. The area is not required to be any larger than that which is sufficient to allow toner adhering to the sealing member 10*d* to electrostatically move to the photosensitive drum 1. Rotation of the photosensitive drum 1 causes the charged area to reach the sealing member 10*d* and the residual toner adhering to the said sealing member 10*d* is electrostatically attracted to the above-mentioned area. After time t3 from the end of the action of the the time t2 as shown in FIG. 3(*d*) (time during which the above-mentioned area is passed through the exposure area) the control unit 22 actuates again the main charger 3 to perform a normal copying action. Thereafter, a latent image area of the photosensitive drum 1 for forming an electrostatic latent image corresponding to the content of original document from the optical system 24 is charged. After that, the control unit 22 operates the optical system 24 to transmit light corresponding to the content of the document to the said latent image area and to form an electrostatic latent image. The electrostatic latent image is changed into a toner image by the developing unit 5, and the toner image moves toward the image transfer device 6.

On the other hand, after the time t4 (time from the charging of the latent image area to the irradiating of the light from the optical system 24 to an edge of the latent image area), the timing rollers 11*a*, 11*b* are driven to feed the transfer paper to the image transfer device 6. In other words, the timing roller 11*a* is driven at the time as shown in FIG. 3(*e*). Simultaneously as the copying paper transported by the said timing roller 11*a*/11*b* enters the image transfer device 6, the said toner image also enters the image transfer device 6 by the rotation of the photosensitive drum 1. The toner image is then electrostatically transferred to the copying paper and then the transferred copying paper is separated from the photosensitive drum 1 by the separating device 7.

The residual toner electrostatically attracted to the area of the photosensitive drum 1 passes through the image transfer device 6 with the rotation of the photosensitive drum 1 before the copying paper is carried to the image transfer device 6. Then, the residual toner is scraped off by the cleaning blade 8*a*.

As mentioned above, when starting the copying operation after replacement of a developing unit by another unit containing toner of a different colour to change the colour of the copy, the residual toner adhering the sealing member 10*d* is attracted by a charged area on the photosensitive drum 1. When copying paper is transferred, the charged area passes the image transfer device 6. Consequently, the colour of the toner used before the replacement of the developing unit is not left on the copying paper.

In the illustrated embodiment, the main charger 3 is operated for the time t2 to charge a certain area of the photosensitive drum 1. However, a similar effect can be obtained by operating the main charger 3 for the time t3 and then operating the blank lamp 4 for a time. It is noted, however, that the blank lamp 4 is operated so as to remove the charge of the particular area from the photosensitive drum 1 which corresponds to the area formed at time t3.

Moreover, in the illustrated embodiment, the time t3 is provided which is a time for suspending the main charger 3. However, if the above-mentioned area is charged immediately before forming an electrostatic latent image for usual copying, there is no need to provide the period of time t3.

In the illustrated embodiment, the replacement of developing units 5 is detected by using loading signals. However, this detection can also be attain by using the output power of a safety switch which is used for stopping the copying machine and which is actuated when a front cover of the copying machine is opened to replace a developing unit 5. The same effect is obtainable by cleaning the residual toner adhering to the sealing member 10*d* each time the print key 21 is operated without using loading signals or the output power of the safety switch. Moreover, referring to the above-mentioned area to be charged on the photosensitive drum 1, to prevent the residual toner carried to the photosensitive drum 1 from sealing member from causing mixing in a fur-brush cleaning system, a charge area is desirably set according to the position of the residual toner.

We claim:

1. A method of cleaning a photoreceptor when replacing one developing unit having toner of one color with another developing unit having toner of another color in an image forming apparatus of the type having a cleaning means for cleaning said rotatable photoreceptor, said developing units being of the type having a sealing means to provide a seal between the photoreceptor and said developing units, comprising the steps of replacing a first developing unit having toner of one color with a second developing unit having toner of another color, starting rotation of said photoreceptor, starting charging of a first area of said rotating photoreceptor, said charging starting after a first period of time has elapsed after having started rotation of said photoreceptor, continuing rotation of said photoreceptor to carry said first charged area to the sealing means of said second developing unit, transferring residual toner of said one color which has adhered to the sealing means of said second developing unit to said first charged area, said residual toner having been transferred to said sealing means of said second developing unit during initial rotation of said photoreceptor, continuing rotation of said photoreceptor to carry said residual toner on said photoreceptor to said cleaning means, effecting removal of said residual toner from said photoreceptor utilizing said cleaning means, and continuing rotation of said photoreceptor to produce a copied image, whereby mixing of colors on the copied image is prevented.

2. A method according to claim 1 further comprising stopping said charging of said first area after a second period of time has elapsed after having started said charging such that the photoreceptor continues to rotate during said second period of time to provide a charged area sufficient to allow the toner of said one color adhering to said sealing means of said second developing unit to be electrostatically transferred to said photoreceptor.

3. A method according to claim 2 further comprising the steps of starting a second charging of said photoreceptor after a third period of time has elapsed after having stopped the first said charging, said second charging providing on said photoreceptor a latent image corresponding to an original document to be copied, and starting feeding of a sheet on which a copy is to be made to said photoreceptor after a fourth period of time has elapsed after having started said second charging such that said latent image on said phtotreceptor is electrostatically transferred to said copy sheet as said residual toner on the first said charged area of said photoreceptor passes to said cleaning means without being transferred to said copy sheet.

4. A method according to claim 1 further comprising the steps of charging a second area of said photoreceptor to provide a latent image corresponding to an original document to be copied, starting feeding of a sheet on which a copy is to be made to said photoreceptor after running period of time has elapsed after having started rotation of said photoreceptor such that said latent image in said second are of said photoreceptor is electrostatically transferred to said copy sheet while said residual toner on the first said area of said photoreceptor passes to said cleaning means without being transferred to said copy sheet.

5. A method according to claim 4 comprising continuing said charging of said first area for a second period of time, subsequently stopping said charging for a third period of time, and thereafter starting a second charging to provide said second charged area with said latent image.

6. A method according to claim 5 wherein said steps of starting feeding of said sheet occurs after a fourth period of time has elapsed after having starting said second charging, the total of said first, second, third and fourth periods of time being equal to said running time.

7. A method according to claim 4 comprising charging said first area follwed by charging of said second area without interruption of the charging.

8. A method according to claim 4 further comprising continuously charging said photorecptor during said running time.

9. A method according to claim 4 comprising continuing said charging of said first area for a second period of time, thereafter continuing charging of an intermediate area of said photoreceptor for a third period of time, thereafter continuing said charging to provide said second charged area with said latent image, and blanking said intermediate charged area to remove the charge from said intermediate area.

10. A method for preventing mixing of colors on copies produced on an electrostatic copying machine when replacing one developing unit having toner of one color with another developing unit having toner of another color in said electrostatic copying machine, said copying machine being of the type having a roatable photoreceptor drum and a cleaning means for cleaning said drum, said developing units being of said type having a sealing means to provide a seal between said drum and the developing unit, comprising removing a first developing unit having a toner of one color from said copying machine, installing in said copying machine a second developing unit having a toner of another color, starting rotation of said drum, starting charging of a first area of said rotating drum, said charging starting after a first period of time has elapsed after having started rotation of said drum, continuing rotation of said drum to carry said first charged area to said sealing means of said second developing unit, transferring residual toner of said one color which has adhered to the sealing means of said second developing unit to said first charged area of said drum, said residual toner having been transferred from said drum to said sealing means of said second developing unit during initial rotation of said drum, continuing rotation of said drum to carry said residual toner on said drum to said cleaning means, effecting removal of said residual toner from said drum utilizing said cleaning means, and continuing rotation of said drum to produce a copied image utilizing said toner of said second developing unit as said residual toner is carried on said drum to said cleaning means without having been transferred to said copy sheet.

11. In an electrostatic copying machine of the type in which a developing unit having one toner is replaceable with another developing unit having another toner, the combination comprising a rotatable photoreceptor drum, a developing unit having toner therein and having a sealing means providing a seal with said drum, cleaning means for cleaning said drum, charging means for charging said drum, said charging means being disposed downstream of said cleaning means and upstream of said developing unit, transfer means for receiving a copy sheet and to effect transfer of a latent image from said drum to said copy sheet, said transfer means being disposed downstream of said developing unit and upstream of said cleaning means, sheet feeding means for feeding a copy sheet to said transfer means, loading signal producing means producing a signal indicating that a developing unit has been replaced in the copying machine, and control means receiving said signal to control operation of said sheet feeding means such that said sheet feeding means starts feeding a copy sheet after said drum has partially rotated for a predetermined period of time during which time residual toner from a prior developing unit, which has been transferred to said drum from said cleaning means during initial rotation of said drum, is carried past said transfer means toward said upstream cleaning means before a copy sheet is fed to said transfer means by said sheet feed means, whereby said residual toner from said prior developing unit is precluded from being transferred to said copy sheet.

12. In an electrostatic copying machine according to claim 11 wherein said developing unit has an opening which opens up onto said drum, said opening having an upstream end and a downstream end, said sealing means being located at said upstream end, said control means being operable to charge an area of said drum after said drum has started to rotate such that residual toner of the prior developing unit which adheres to said sealing means during the initial rotation of said drum is transferred to said charged area and carried past said transfer means before a copy sheet is fed to said transfer means.

13. In an electrostatic copying machine according to claim 11 wherein said cleaning means is operable to clean said residual toner of said prior developing unit from said drum.

* * * * *

UNITED STATES PATENT OFFICE

CERTIFICATE OF CORRECTION

Patent No. 4,764,790 Dated August 16, 1988

Inventor(s) Masahiro WATASHI

It is certified that error appears in the above-identified patent and that said Letters Patent are hereby corrected as shown below:

Claim 3, line 10, change "phtotrecep-" to -- photorecept- --.

Claim 4, line 8, after "said second" change "are" to -- area --.

Claim 8, line 2, change "photorecptor" to -- photoreceptor --.

Signed and Sealed this

Seventeenth Day of January, 1989

*Attest:*

DONALD J. QUIGG

*Attesting Officer* *Commissioner of Patents and Trademarks*

UNITED STATES PATENT OFFICE

CERTIFICATE OF CORRECTION

Patent No. 4,764,790 Dated August 16, 1988

Inventor(s) Masahiro WATASHI

It is certified that error appears in the above-identified patent and that said Letters Patent are hereby corrected as shown below:

Claim 11, col. 7, line 11, thereof, before "cleaning means" delete "upstream".

Signed and Sealed this

Fourteenth Day of March, 1989

*Attest:*

*Attesting Officer*

DONALD J. QUIGG

*Commissioner of Patents and Trademarks*